US007147342B2

(12) United States Patent
Burnidge

(10) Patent No.: US 7,147,342 B2
(45) Date of Patent: Dec. 12, 2006

(54) CONTAINER ILLUMINATED BY HANDLE/STRAP

(76) Inventor: Lane E. Burnidge, 17N400 Big Timber, Hampshire, IL (US) 60140

( * ) Notice: Subject to any disclaimer, the term of this patent is extended or adjusted under 35 U.S.C. 154(b) by 11 days.

(21) Appl. No.: 10/883,135

(22) Filed: Jul. 1, 2004

(65) Prior Publication Data

US 2004/0240199 A1 Dec. 2, 2004

Related U.S. Application Data

(63) Continuation-in-part of application No. 09/974,304, filed on Oct. 10, 2001, now Pat. No. 6,776,501.

(51) Int. Cl.
*A45C 15/06* (2006.01)

(52) U.S. Cl. ..... 362/156; 362/577

(58) Field of Classification Search ..... 362/156
See application file for complete search history.

(56) References Cited

U.S. PATENT DOCUMENTS

| | | | | | |
|---|---|---|---|---|---|
| 2,554,603 | A | * | 5/1951 | Terlinde | 362/156 |
| 2,644,882 | A | | 7/1953 | Voda | |
| 3,112,889 | A | * | 12/1963 | Marmo et al. | 362/103 |
| 3,638,258 | A | * | 2/1972 | Black | 362/108 |
| 4,234,907 | A | * | 11/1980 | Daniel | 362/108 |
| 4,523,258 | A | | 6/1985 | Morse et al. | |
| 5,008,595 | A | | 4/1991 | Kazar | |
| 5,052,131 | A | | 10/1991 | Rondini | |
| 5,143,440 | A | * | 9/1992 | Trampota | 362/156 |
| 5,475,574 | A | | 12/1995 | Chien | |
| 5,512,843 | A | * | 4/1996 | Haynes | 324/772 |
| 5,535,106 | A | | 7/1996 | Tangen | |
| 5,547,190 | A | | 8/1996 | Mackewich, Jr. et al. | |
| 5,607,226 | A | | 3/1997 | Toth et al. | |
| 5,913,671 | A | | 6/1999 | Fernandez et al. | |
| 6,135,621 | A | | 10/2000 | Bach et al. | |
| 2002/0105798 | A1 | * | 8/2002 | Hill | 362/156 |
| 2002/0116791 | A1 | | 8/2002 | Grady et al. | |

OTHER PUBLICATIONS wordnet.Princeton.edu/erl/webwn.*

* cited by examiner

*Primary Examiner*—Ali Alavi
*Assistant Examiner*—William J Carter
(74) *Attorney, Agent, or Firm*—Michael Ries & Associates

(57) ABSTRACT

An illuminating handle/strap for lifting, pulling, carrying, opening, holding a container and the like is presented. The light source is the handle/strap. Illumination can occur in different ways by aiming the light emitting means. Directions can be: generally, as in all directions; partially, such as down into a container, at what it is attached to, or towards the person using it; specifically, such as at signage on or adjacent to what it is attached to; or in a combination of several directions at once. Different or combinations of light emitting means can be used. The handle can be rigid or flexible. This is a simple cost effective way to increase visibility and safety.

32 Claims, 3 Drawing Sheets

CONTAINER ILLUMINATED BY HANDLE/STRAP

CROSS-REFERENCE TO RELATED PATENT APPLICATIONS

This patent application is a continuation-in-part of U.S. patent application Ser. No. 09/974,304, filed Oct. 10, 2001 now U.S. Pat. No. 6,776,501, and hereby incorporated in its entirety.

FIELD OF THE INVENTION

This invention pertains to a handle, and more particularly to an improved way to illuminate the handle, its surroundings and the container to which the handle is attached.

BACKGROUND OF THE INVENTION

Not being able to see something or being seen by others carrying something has been a problem since God separated night and day. Others have partially solved the problem. U.S. Pat. No. 6,135,621 discloses a back lit grab bar for stairways, clothes racks, and the like. U.S. Pat. No. 5,913,671 discloses fishing implements with illuminating inserts and U.S. Pat. No. 2,644,882 discloses a handle illuminating the inside of a refrigerator. All solve their stated problem, none of which involve illuminating the interior.

None of these reference teach or suggest a flexible or rigid handle that illuminates the inside or outside of the container to which they are attached. Such a handle is useful for illuminating trick or treat carriers, medical equipment, inside purses, signage, key holes, and the like.

SUMMARY OF THE INVENTION

The invention provides the use of lamps and reflectors, light emitting diodes, or electroluminescent or chemical luminescent lights placed on or in a handle to aim light or as the handle itself to aim light. Such a use is very useful for illuminating.

The object of the present invention is to provide an improved illuminating handle, which can be flexible or rigid, in which the light source is the handle. The handle is highly visible and can direct light at a target, to the object to which it is attached, or its surroundings.

Other aspects, objectives and advantages of the invention will become more apparent from the following detailed description when taken in conjunction with the accompanying drawings.

BRIEF DESCRIPTION OF THE DRAWINGS

The accompanying drawings, which are incorporated into and constitute part of this specification, illustrate an embodiment of the invention, and together with the detailed description below, serve to explain the invention in greater detail.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The following description is provided to enable one skilled in the art to make and use the invention and sets forth the best mode of the invention. Variations of the invention will be readily apparent to those skilled in the art. The invention provides a container handle that illuminates the container to which it is attached. The handle comprises chemical luminescent, incandescent, LED (light emitting diode), halogen or electroluminescent light sources and the like and means for connecting the light source to a power source when the light source uses electrical means. The container handle may be of different shapes and material. For example, the handle material may be a laminate, a circuit board, a multiple strip, a rope, plastic, etc. The container may be of any shape (e.g., plates, trays, planters, cups, bags, drawers, tubs, holiday containers such as Halloween and Easter carriers, gift bags, plastic boxes, etc.) and holds items such as food staples, candy, medical devices, medicine, shopping items, tools, parts, ammunition, etc. and the like. The container material may be plastic, ceramic, paper, woven wire, cloth, and the like. The means for connecting the light source to a power source includes wire, a rigid or flexible single layer or multi-layer circuit board, conductive strips, bus bars, molding, high frequency carrier signal, and the like. Note that when chemical luminescence is used, the use may be a one time use or the handle may be a replaceable handle or a replaceable chemical illuminator.

Figure 1:
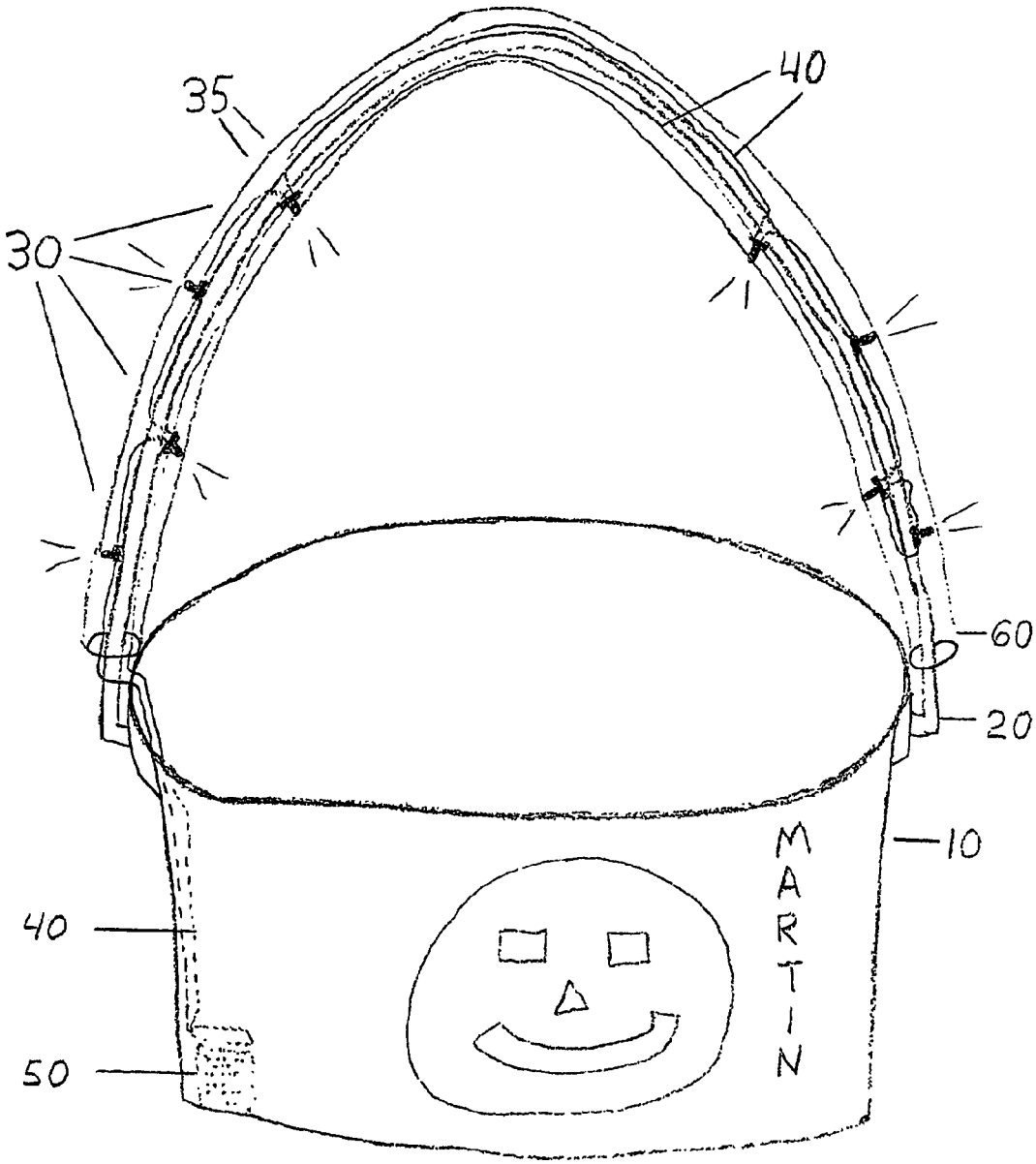
FIG. 1 illustrates an illuminating handle in accordance with the teachings of the present invention with lights shining into and illuminating away from the container making it quite visible.

Turning to the drawings, wherein like reference numerals refer to like elements, FIG. 1 shows an embodiment of a container 10 with its strap handle 20. Holes have been punched though the strap to hold the lamps 30 (e.g., Light Emitting Diodes, incandescent, electroluminescent, etc.) in place. Lead wires 35 on the lamps are bent to aim the light in the desired direction. The lamps 30 are connected as needed (e.g., series/parallel) by wires 40 to the battery 50. A clear tube 60 may encase the handle 20 with its lights 30 and wires 40 inside. Alternatively, the handle assembly may be dipped in plastic and the like such that the lead wires and the like are coated by the plastic. The battery rests inside the container 10 or outside the container 10 in a battery holder.

Figure 2:
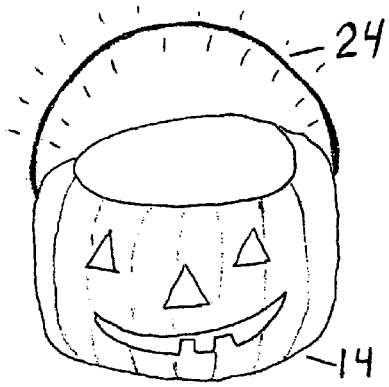
FIG. 2 illustrates a container illuminated using chemical luminescent material for a handle in accordance with the teachings of the present invention.

FIG. 2 shows a container 14 with a chemical luminescent (e.g., break and glow) handle 24 illuminating the container and its surroundings.

Figure 3:
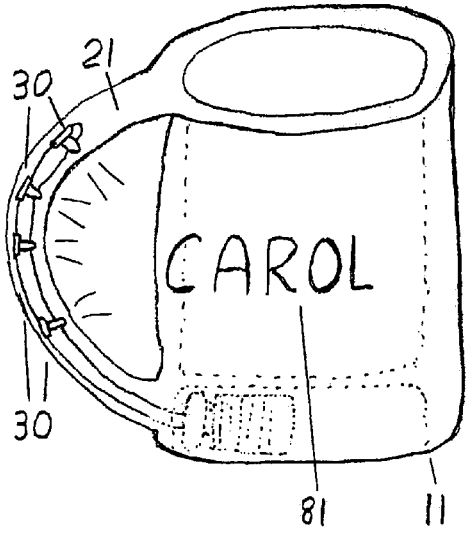
FIG. 3 illustrates a mug with light shining from within the handle onto a name printed on the mug in accordance with the teachings of the present invention.

FIG. 3 shows a container (e.g., a cup) 11 with the handle 21, which is tubular, solid, or rigid, having lights 30 aimed at signage 81.

Figure 4:
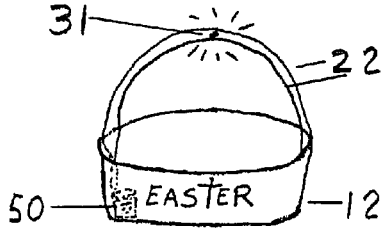
FIG. 4 illustrates a simple basket with a handle, rigid or flexible, made of two conductors with a light wired between them, in accordance with the teachings of the present invention, illuminating the basket and its surroundings.

FIG. 4 shows a container 12 where the handle is made from two handle straps 22 that are also conductors connected to a battery 50. Lamp 31 is connected between the handle straps 22 and illuminates the container 12 and its surroundings.

Figure 5:
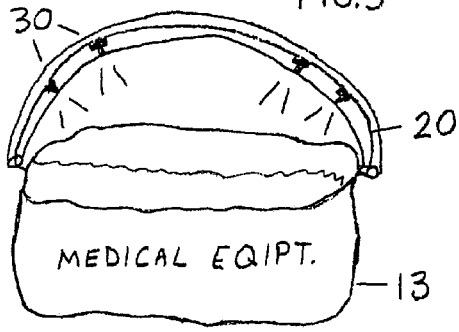
FIG. 5 illustrates a bag having a lighted handle in accordance with the teachings of the present invention with the bulk of light shining onto the top of the bag and when opened, onto the contents inside the bag.

FIG. 5 shows a flexible handle 20 with lights 30 illuminating a cloth bag 13.

Figure 6:
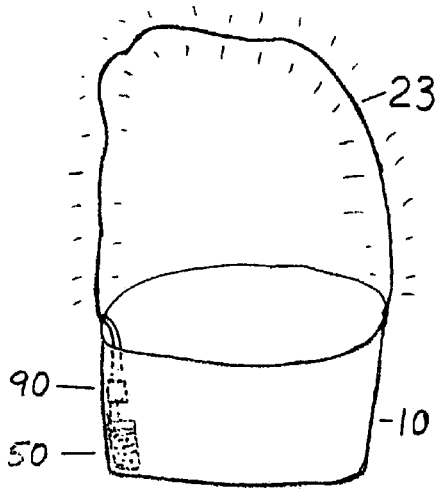
FIG. 6 is a container using only flexible electroluminescent material for a handle in accordance with the teachings of the present invention.

FIG. 6 shows handle 23 made of electroluminescent material illuminating the container 10 and its surroundings, battery 50 and its controller 90 inside the container 10.

In one embodiment, the power source is a 9V battery. For example, in FIG. 1, the battery is connected to four light emitting diodes in series aimed at the container and four light emitting diodes in series aimed away from the container. Additionally, the container can be illuminated with chemical light shining from the handle as in FIG. 2.

Figure 7:
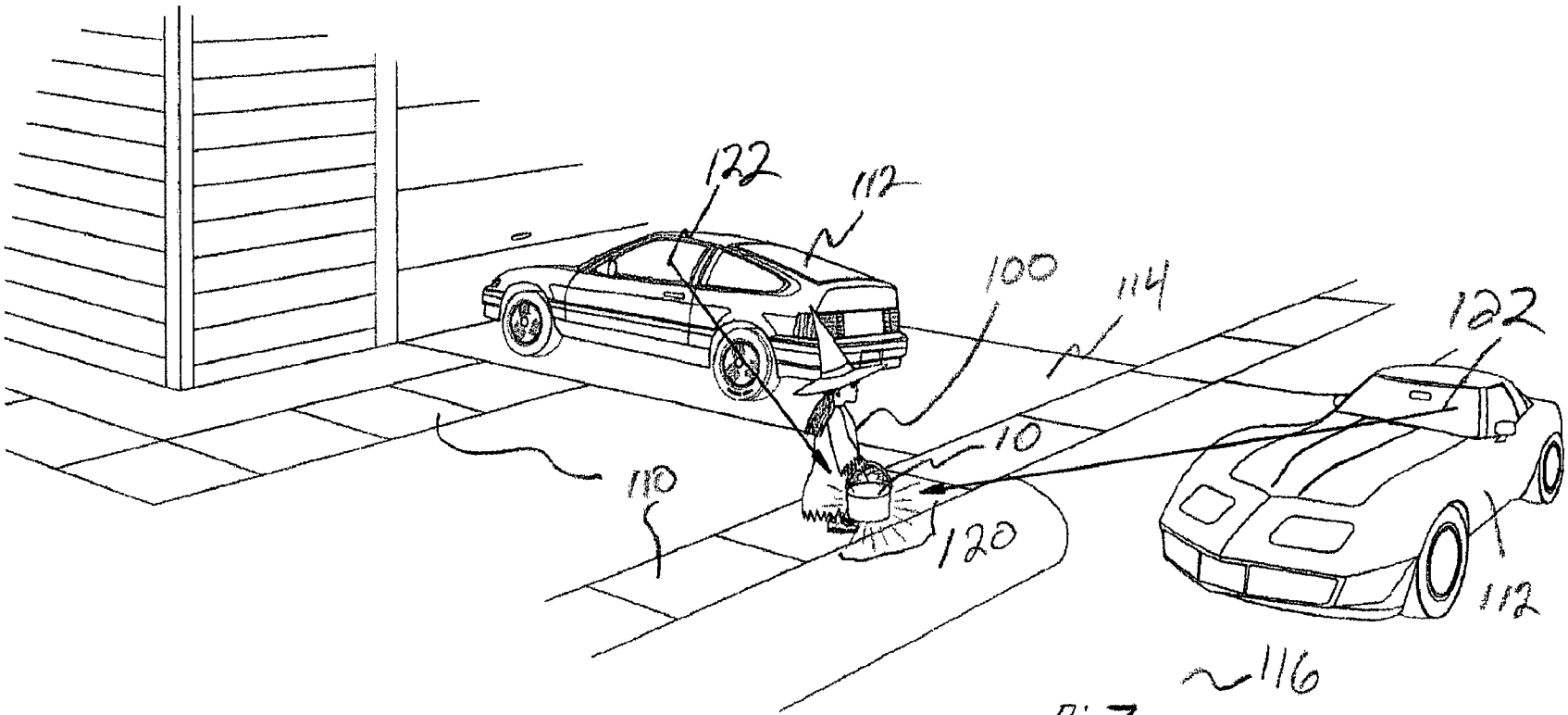
FIG. 7 as in one embodiment shows drivers being alerted of a child's presence by a light passing through container walls.

FIG. 7 as in one embodiment shown is a small child 100 dressed up like a witch walking down a sidewalk 110 with vehicles 112 in driveways 114 and on the nearby street 116 with the container 10 illuminating the light through the container walls 120 to alert the drivers 122 of the vehicles 112 of the presence of the child 100. This provides an important safety function by alerting vehicle's drivers of the presence of small children and then the goal is to have them proceed with caution.

The handle 20, 21, 22, 23, 24 may be flexible, rigid, semi-flexible, or semi-rigid, solid or tubular. It may be part of the container itself or connected to the container in a variety of ways. For example, it may be riveted (e.g., a "star" rivet), glued via an adhesive, sewn, snapped, a tongue and groove mechanism, harpooning, welded, wired, molded, etc. The handle may also be clear, black, or colored.

While the above drawings describe the illuminating handle/shoulder strap, other variations are contemplated within its scope. Those include other handles, how to connect them, one or more flashing lights, incandescent bulbs with and without reflectors, surface mount light emitting diodes, photo switches, pull switches, motion and other types. Also other means to securing the lights, battery placement or separate holder in handle or container are contemplated. Other variations using electroluminescent materials, chemical luminescent components, or hard wiring to utility grid, and ways to secure the handle/strap in a specific orientation are also considered within the scope of the invention.

The various aspects of the invention provide a novel concept for a simple, inexpensive illuminating handle/shoulder strap for improving the safety of children trick or treating and others in their night activities or in dark environments.

While the present invention has been illustrated by the description of the preferred embodiments, it is not the intention of the applicant to in any way limit the scope of the appended claims. Additional modifications and advantages will be readily apparent to one skilled in the art. Therefore, the invention's scope is not to be limited to the specific described embodiments.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A container illuminated by a handle wherein the handle comprises:

one or more light sources placed laterally along said handle wherein at least one of the one or more light source is always directed toward the container such that at least one light source is illuminating the container when the at least one light source is emitting light, the at least one light source illuminates the container so that light is visible through container walls and illuminates surroundings to provide safety to a person carrying the container;

an electrical connection for receiving an electricity source; and means for connecting the one or more light sources to the electrical connection.

2. The container of claim 1 wherein the at least one or more light source is a chemical light.

3. The container of claim 2 wherein the chemical light comprises a chemical luminescent light emitting source.

4. The container of claim 1 further including means for attaching the handle to the container.

5. The container of claim 1 wherein the means for connecting the one or more light sources to the electrical connection comprises wire.

6. The container of claim 1 wherein the means for connecting the one or more light sources to the electrical connection comprises a circuit board.

7. The container of claim 6 wherein the circuit board comprises a flexible circuit board.

8. The container of claim 1 wherein the means for connecting the one or more light sources to the electrical connection comprises at least one conductive strip.

9. The container of claim 1 wherein the means for connecting the one or more light sources to the electrical connection comprises a high frequency carrier signal.

10. The container of claim 1 wherein the one or more light sources is selected from the group consisting of a light emitting diode, an incandescent lamp, and a halogen lamp.

11. The container of claim 10 wherein the group further comprises an electroluminescent light.

12. The container of claim 1 wherein the one or more light sources comprises one or more chemical lights.

13. The container of claim 1 wherein at least one of the one or more light sources is flashing.

14. The container of claim 1 wherein the container comprises one of a cup, a bag, a tub, a holiday container, and a gift bag.

15. The container of claim 1 wherein the container comprises one of a plate, a tray, a planter, a bucket, a pail, a drawer, and a box.

16. The container of claim 1 wherein the container comprises one of plastic, ceramic, paper, woven wire, steel, wood, and cloth.

17. A handle for illuminating a container comprising:

one or more light sources placed laterality along the handle wherein at least one of the one or more light source is always directed toward the container such that at least one light source is illuminating the container when the at least one light source is emitting light, the at least one light source illuminates the container so that light is visible through container walls and illuminates surroundings to provide safety to a person carrying the container;

an electrical connection for receiving an electricity source; and means for connecting the one or more light sources to the electrical connection.

18. The handle of claim 17 further comprising means for attaching the handle to the container.

19. The handle of claim 18 wherein the means for attaching the handle to the container comprises wire.

20. The handle of claim 18 wherein the means for attaching the handle to the container comprises molding the handle to the container.

21. The handle of claim 18 wherein the means for attaching the handle to the container includes attaching the handle to the container at least at one point.

22. The handle of claim 17 wherein the means for connecting the one or more light sources to the electrical connection comprises wire.

23. The handle of claim 17 wherein the means for connecting the one or more light sources to the electrical connection comprises a circuit board.

24. The handle of claim 23 wherein the circuit board comprises a flexible circuit board.

25. The handle of claim 17 wherein the means for connecting the one or more light sources to the electrical connection comprises at least one conductive strip.

26. The handle of claim 17 wherein the means for connecting the one or more light sources to the electrical connection comprises a high frequency carrier signal.

27. The handle of claim 17 further comprising one of a sleeve and a cover.

28. The handle of claim 27 wherein the one of the sleeve and the cover comprises a tube.

29. The handle of claim 27 wherein the one of the sleeve and the cover comprises a coating.

30. The handle of claim 17 wherein the one or more light sources is consists of one or more of a light emitting diode, an incandescent lamp, and a halogen lamp.

31. The handle of claim 17 wherein the one or more light sources comprises one or more electroluminescent lights.

32. The handle of claim 17 wherein at least one of the one or more light sources is flashing.

* * * * *